United States Patent [19]

von der Eltz et al.

[11] 3,986,831

[45] Oct. 19, 1976

[54] PROCESS FOR THE DYEING OF KNIT-FABRICS OF SYNTHETIC FIBER MATERIALS

[75] Inventors: Hans-Ulrich von der Eltz; Richard Bruno Wassner, both of Frankfurt am Main, Germany

[73] Assignee: Hoechst Aktiengesellschaft, Frankfurt am Main, Germany

[22] Filed: May 30, 1975

[21] Appl. No.: 582,389

Related U.S. Application Data

[62] Division of Ser. No. 379,398, July 16, 1973, abandoned.

[30] Foreign Application Priority Data

July 18, 1972 Germany ..... 2235135

[52] U.S. Cl. ..... 8/149.1; 8/149.3; 68/5 E; 68/22 B; 68/DIG. 5

[51] Int. Cl.[2] ..... D06B 3/02; D06B 21/02

[58] Field of Search ..... 8/149.1, 149.3; 68/5 D, 68/5 E, 6, 22 B, DIG. 5

[56] References Cited

UNITED STATES PATENTS

| | | | |
|---|---|---|---|
| 3,058,327 | 10/1962 | Hablutzel et al. | 68/5 E |
| 3,621,679 | 11/1971 | Greer | 68/5 E |
| 3,687,607 | 8/1972 | Yazawa | 8/149.1 |
| 3,730,678 | 5/1973 | Wedler et al. | 8/149.1 |

FOREIGN PATENTS OR APPLICATIONS

| | | | |
|---|---|---|---|
| 1,430,549 | 1/1966 | France | 68/22 B |

*Primary Examiner*—Philip R. Coe
*Attorney, Agent, or Firm*—Curtis, Morris & Safford

[57] ABSTRACT

Rapid dyeing process for piece-goods, especially knit fabrics, of synthetic fibre materials, preferably of texturized polyester fibers, by padding the material with an aqueous dyebath in a pressure vessel, which may be used both for the application and fixation of the dyestuff, at first under high-temperature (HT—) conditions and then exposing the material immediately after this operation to the action of high-pressure (HP)—steam to fix the dyestuff completely.

4 Claims, 1 Drawing Figure

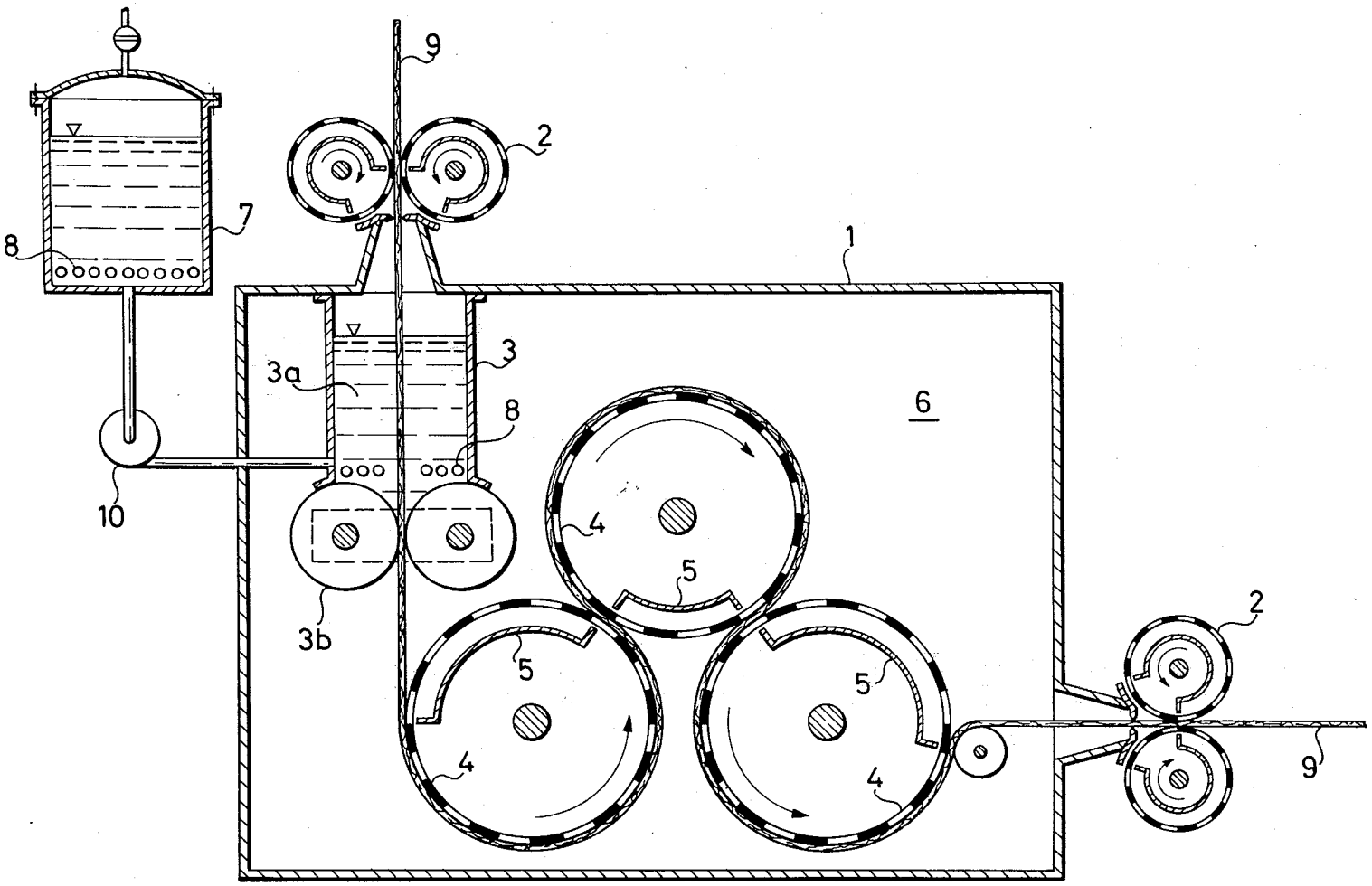
1
2
2
3
3a
3b
4
4
4
4
5
5
5
5
6
7
8
8
9
9
10

PROCESS FOR THE DYEING OF KNIT-FABRICS OF SYNTHETIC FIBER MATERIALS

This is a division, of application Ser. No. 379,398, filed July 16, 1973, and now abandoned.

The present invention relates to a process for the dyeing of knit-fabrics of synthetic fibre materials.

It is known and generally usual that synthetic fibre material is dyed according to a continuous process. Though in such dyeing processes knit-fabrics and other textile flat materials sensitive with regard to fineness or structure cause difficulties, these difficulties have been overcome to a large extent, as it is known from the literature and patent specifications. However, high production speeds cannot be achieved by this way. Furthermore it may occur that the formation of a condensate causes undesired secondary effects which impair the appearance of the goods.

It has now been found that the difficulties existing in the dyeing of piece-goods, especially of knit-fabrics from synthetic fibre materials, preferably from texturized polyester fibres, can be eliminated and that a high production speed is possible in such processes, when padding the material with an aqueous dye-bath in a pressure vessel, which may be used both for the application and fixation of the dyestuff, at first under high-temperature (HT)— conditions and then exposing the material immediately after this operation to the action of high-pressure steam (HP) to fix the dyestuff completely.

The condition to the practicability of the present invention is a chamber hermetic to pressure containing a chassis to be heated indirectly with a small capacity and a feed for the dye-bath which can be regulated exactly. The dyebath enters through a pipe line from one or several store tanks hermetic to pressure and heatable. The small contents of the chassis ensures a rapid consumption of the padding bath during the application of the dyestuff. Therefore, a tailing of the shades toward the side of the padded material, i.e. alterations of the shade in its color intensity are not possible. When entering the pressure chamber the material is immediately heated to the ambient temperature and immersed hot into the chassis of the foulard. In the case of such unusually high padding temperatures the textile material is wetted quickly by the dye-bath. Under these conditions the dyestuff has a considerable affinity with the synthetic fibre. According to the process claimed the temperature of the padding bath can be adjusted to the range of from 105° to 135° C, which ensures that the temperature most favorable for each dyestuff and each dyestuff combination can be maintained.

According to the present invention the pressure-steamchamber is either a common chamber with contains the padding device and means for pressure-steam fixation, or the pressure-steamer is divided into two compartments: the padding chamber and the high-pressure steam chamber itself. In the case of the two chamber system, however, the wall of the chassis can be formed in such a way as to represent the limit toward the high-pressure steam chamber. The foulard or the impregnation device always form the lower part of the chassis; in the case of the two chamber-pressure-steaming device the chassis also separates the padding chamber having a temperature of from 105° to 130° C from the high-pressure steaming chamber. The difference of pressure between these two chambers is not very big in each case, so that equipments for maintaining such differences in pressure are not necessary. The temperatures in the high-pressure steaming chamber for fixing the dyestuffs impregnated onto the material generally range according to the invention between 125° and 145° C, corresponding to about 1.3 – 3.2 atmospheres gauge. In the two chamber system the temperature need not be the same in both chambers of the pressure vessel, a fact which has strongly impaired the production speed in the known processes of the prior art. According to the process claimed the HP-steaming temperature will preferably be 10° to 20° higher than the HT-padding temperature. The steaming process for fixing the dyestuff is effected by means of sieving drums, as they are described for example in Swiss Patent Specification Nos. 509,452 and 515,373. Thus, according to the invention the temperature most favourable for the padding operation is maintained; the conditions required for the final fixation of the dyestuffs are found in the steamer. A roller lock, preferably of the type described in German Pat. Specification No. 1,760,732 locks the HP - steaming chamber toward the external atmosphere. Within the common pressure vessel behind the transport element consisting of sieving drums a HT-hot water passage may be placed in the steaming chamber to after-treat the dyed material. In the most simple case one or several of the last sieving drums are immersed completely or partly in the HT-bath.

As regards the practicability of the new dyeing process, it was not considered possible and, thus, could not be forseen that in the case of transport speeds above the usually applied speeds according to prior art, full shades on perfectly even and completely penetrated materials can be obtained. According to the invention the fixation of the dyestuff is effected very quickly and uniformly in each case. A full-width stretching device or analogously formed device is not necessary for the smooth transport of the material, free from folds, since the roller lock fixed at the inlet of the pressure-steamer serves as a full-width stretching device and furthermore works without any tension. As a special advantage of the process claimed may be mentioned that the dimensions of space in the whole pressure chamber may be kept small. Furthermore, the formation of a condensate is quite impossible with this method of operation, since the material is brought into contact with the dye-bath already in a heated-up state.

The textile fabrics to be dyed according to the process claimed are piece-goods, especially sensitive knit-fabrics, from hydrophobic fibres such as cellulose-triacetate, polyamide, polyurethane, preferably polyester fibres. In the padding liquors the usual types of dyestuffs are used for these fibres, above all disperse dyestuffs or acid and anionic metal complex dyestuffs. Such dyestuffs are described in Colour Index, third edition under the term of Disperse Dyes and Acid Dyes.

The invention further relates to a device to carry out the dyeing process described above, consisting of a preferably common pressure vessel for the application and fixation of the dyestuff, in which are placed both the high-temperature (HT)-padding chamber with chassis and foulard, and the high-pressure (HP)-steaming chamber with transport means which permit a transport of the material without tension. Preferred is a device in which the HT-padding chamber is not separated from the HP-steaming chamber within the common pressure vessel. It is also possible that the HT-padding chamber is separated from the HP-steaming chamber within the common pressure vessel by a sealing element, for example a roller lock, an elastic lip lock, in combination with chassis walls extending to the wall of the pressure vessel. The transport element for the material during the fixation by heat in the HP-steaming chamber consists of at least two perforated drums connected in a series and rotating in axial direction, which are under a relative suction-draught in the sense of the interior of the drum, and the surface area of which may be covered with at least one layer of a micromash screen cloth. (sieve fabric). Furthermore, the HP-steaming chamber contains suitable means for supplying and taking off the pressure steam. Finally the pressure vessel is sealed at the inlet and the outlet for the material to be treated by a pressure sealing element, preferably a roller lock consisting of sieve drums having a relative suction draught, toward the atmospheric external pressure.

In detail the dyeing process proceeds as follows: As in the case of processes hitherto known the material is introduced into the pressure room itself 1 through a roller lock 2. This room normally consists of a chamber, but it may also be divided into two chambers. After heating up the material directly when entering the steam atmosphere it is passed over a foulard **3*b* or another impregnation device, in which the upper pair of rollers horizontally mounted simultaneously represents the bottom of a small chassis 3. The bath 3*a* of this chassis is prepared outside the pressure chamber in a store vessel 7, preheated and enters the chassis via an injection pump through injection pipes which are placed parallely to the foulard rollers. The inlet apertures are arranged in the way that the bath sprinkles under pressure on the wall of the chassis, is mixed with the rest of the bath and comes only then in contact with the material passed through the device. After padding with the bath heated to 105° – 130° C the material enters the steam fixation chamber itself 6. At steaming temperatures of about 125° to 145° C the material passed over sieve drums 4 is exposed for 2 to 3 minutes to the action of pressure steam and then leaves the pressure chamber by a big roller lock 2** to the outside of the device. The fixation is followed by a usual after-treatment.

A concrete Example for a device according to the invention is given in the annexed FIGURE in cross section.

Reference numbers to the FIGURE:

1. pressure vessel
2. roller lock for sealing pressure toward outside
3. HT-padding chamber (chassis) heated indirectly
**3*a*.** padding liquor
**3*b*.** foulard
4. sieve drums under a relative suction draught
5. covering sheets
6. HP-steaming chamber
7. HT-preparation and feeding vessel, heated indirectly
8. heating elements
9. material
10. pump The following Examples illustrate the invention.

EXAMPLE 1

In a pressure vessel piece goods of texturized polyester fibres having an elastic crepe structure were padded with an aqueous bath at 125° C and a liquor pick-up of 70 % by weight, calculated on the dry fibre material; the bath container per liter 30 g of the disperse dyestuff of the formula I

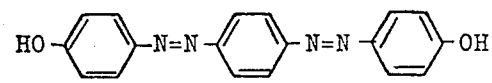

(I)

and was adjusted to pH with acetic acid. After padding the material was continuously steamed for 3 minutes at 2.2 atmospheres gauge. After leaving the pressure vessel over a roller lock (pressure sealing) the dyeing thus produced was rinsed and worked up as usual. A golden yellow dyeing giving a good evenness and a good penetration of the material was obtained.

EXAMPLE 2

Stretch fabrics of texturized polyester fibres were introduced over a full-width stretching device into a pressure vessel and padded at 120° C on a foulard with an aqueous bath, the liquor pick-up being 70 % by weight, which contained per liter 20 g of the disperse dyestuff of the formula II

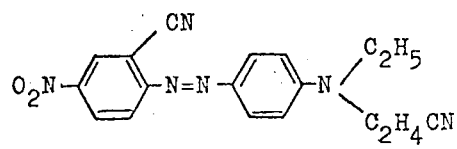

(II)

2 g of a non-ionic thickening agent on the basis of fully etherified (methylated) locust bean flour as well as 2 g of a non-ionic emulsifier of the type of the reaction product of 1 mol of castor oil and 36 mols of ethylene oxide and was adjusted to pH 5 with acetic acid.

After padding the material was introduced into the HP-steaming chamber and steamed for 3 minutes at 2.1 atmospheres gauge. Immediately after this operation the material was rinsed and worked up as usual. A red dyeing was obtained giving a very good evenness and a good penetration within the stretch fabric.

EXAMPLE 3

A structure fabric of texturized polyester fibres with Piqué effect was padded in an autoclave at 130° C on a foulard with an aqueous bath, the liquor pick-up being 70 % by weight, which contained per liter 20 g of the disperse dyestuff of the formula III

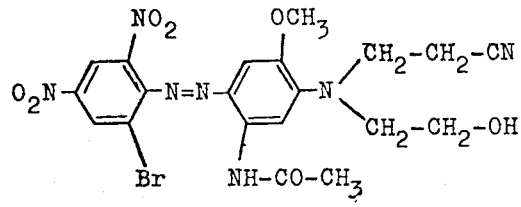

(III)

5 g of a non-ionic thickening agent on the basis of fully etherified (methylated) locust bean flour as well as 2 g of a non-ionic wetting agent of the type of the reaction product of 1 mol of isotridecanol and 5 mols of ethylene oxide and was adjusted to pH 5 with acetic acid.

After heating and padding the material was introduced into the continuous HP-steamer and steamed under pressure for 2 minutes at 2.5 atmospheres gauge. The material left the pressure vessel over a roller lock, was rinsed and worked up in usual manner. An intense blue dyeing was obtained having a very good evenness and a good penetration of the material.

EXAMPLE 4

A crêpe material of texturized polyester fibres was padded in a pressure vessel on a foulard at 115° C and at a liquor pick-up of 70 % by weight with an aqueous bath which contained per liter 15 g of the disperse dyestuff of the formula IV

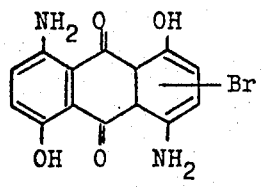

(IV)

8 g of the disperse dyestuff of the formula V

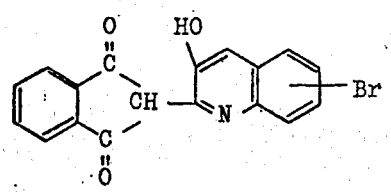

(V)

and 1 g of the disperse dyestuff of the formula VI

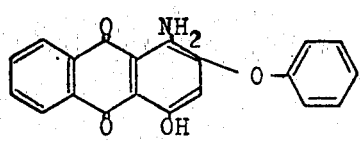

(VI)

and was adjusted to pH 5 with acetic acid.

After padding in the pressure vessel the padded textile material was treated for 2 minutes with saturated steam at 2.7 atmospheres gauge. After leaving the pressure vessel over a pressure sealing the material was rinsed and worked up in usual manner. A full green dyeing was obtained having a very good evenness and penetration of the formula VII

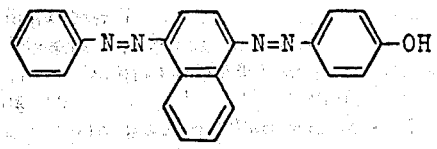

(VII)

and was adjusted to pH 5 with acetic acid.

After padding in the pressure vessel the material was treated for 3 minutes at 1.8 atmospheres gauge with steam under pressure. After leaving the pressure vessel over a roller lock the material was rinsed and worked up in usual manner. A completely even orange dyeing was obtained.

EXAMPLE 6

A fabric of texturized polyamide threads (waved yarn) was padded at 110° C and a liquor pick-up of 70 % by weight on a foulard with an aqueous bath which contained per liter 20 g of an acid dyestuff of the formula VIII

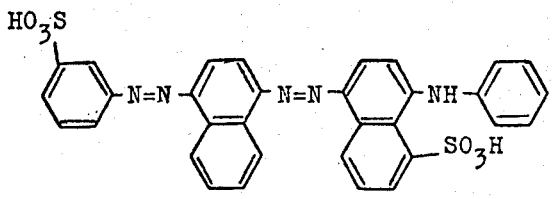

(VIII)

20 g of ethyldiglycol and 6 ml of a 60 % acetic acid. After padding in the pressure vessel the padded material was treated for 3 minutes at 1.7 atmospheres gauge in a high-pressure steam. Then the material was rinsed and worked up as usual. A perfect navy-blue dyeing was obtained.

EXAMPLE 7

A fabric of triacetate fibres, for example taffeta, was padded in a pressure vessel at 120° C and a liquor pick-up of 70 % by weight on a foulard with an aqueous bath which contained per liter 20 g of the disperse dyestuff of the formula IX

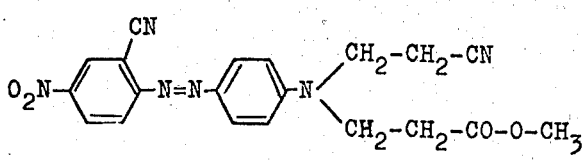

(IX)

and which was adjusted to pH 5 with acetic acid.

After heating up and padding the material was introduced into the high-pressure steamer and steamed under pressure for 2 minutes at 2 atmospheres gauge. The material left the pressure vessel over a roller lock, was rinsed and worked up in usual manner. An intense red dyeing was obtained giving a very good evenness and penetration of the material.

We claim:

1. A process for continuously dyeing piece-goods of synthetic fiber materials, which comprises padding the material with an aqueous dyebath at a temperature of from 105° to 135° C and thereafter immediately exposing the material to the action of high-pressure steam at a temperature of from 125° to 145° C to fix the dyestuff completely, said padding and fixing being carried out in a pressure vessel.

2. A process as claimed in claim 1, wherein the steaming temperature is the same as, or from 10° to 20° C above the padding temperature.

3. A process as claimed in claim 1, wherein the piece-goods are knitted fabrics.

4. A process as claimed in claim 1, wherein the synthetic fiber material is of texturized polyester fibers.

* * * * *